US010570725B2

(12) United States Patent
McCoy et al.

(10) Patent No.: US 10,570,725 B2
(45) Date of Patent: Feb. 25, 2020

(54) PROFILE MEASUREMENT FOR UNDERGROUND HYDROCARBON STORAGE CAVERNS

(71) Applicants: James N. McCoy, Wichita Falls, TX (US); Orvel L. Rowlan, Wichita Falls, TX (US)

(72) Inventors: James N. McCoy, Wichita Falls, TX (US); Orvel L. Rowlan, Wichita Falls, TX (US)

( * ) Notice: Subject to any disclaimer, the term of this patent is extended or adjusted under 35 U.S.C. 154(b) by 162 days.

(21) Appl. No.: 15/621,574

(22) Filed: Jun. 13, 2017

(65) Prior Publication Data

US 2018/0355713 A1 Dec. 13, 2018

(51) Int. Cl.
*E21B 47/10* (2012.01)
*E21B 47/06* (2012.01)

(52) U.S. Cl.
CPC ..... *E21B 47/1025* (2013.01); *E21B 47/06* (2013.01)

(58) Field of Classification Search
CPC ... E21B 47/042; E21B 47/0003; E21B 49/008
See application file for complete search history.

(56) References Cited

U.S. PATENT DOCUMENTS 2,772,564 A 12/1956 Dougherty
2,792,708 A * 5/1957 Johnston, Jr. ..... B65G 5/00 73/149
2,972,050 A * 2/1961 Allen ..... B65G 5/00 250/258
3,049,920 A 8/1962 Allen
4,523,453 A 6/1985 Faul et al.
4,620,439 A 11/1986 Faul et al.
4,624,130 A 11/1986 Faul et al.
5,117,399 A 5/1992 McCoy et al.
5,285,388 A 2/1994 McCoy et al.
8,473,227 B2 6/2013 Olson et al.
(Continued)

FOREIGN PATENT DOCUMENTS

CN 100514018 C 12/2006

OTHER PUBLICATIONS

Brouard B., Karimi-Jafari M., Berest P., Durup G., "Pressure Build-Up in a Sealed Cavern: The effect of a Gas Blanket", Spring 2007 Conference, Apr. 29-May 2, 2007, Basel Switzerland, Solution Mining Research Institute.
(Continued)

*Primary Examiner* — Catherine Loikith
(74) *Attorney, Agent, or Firm* — Dale B. Nixon

(57) ABSTRACT

Underground storage caverns are widely used for the bulk storage of petroleum products, in particular, crude oil. The caverns are accessed through a casing in a borehole down to the cavern. The lower end of the casing opens into an upper region of the cavern termed the chimney. The chimney provides a transition from the casing into the cavern body. The invention presents a process of injecting a gas into the well while measuring the gas pressure and optionally measuring the volume of injected gas. The gas drives down an interface between the gas and hydrocarbon liquid. By monitoring the rate of change of the gas pressure, and detecting a sudden decrease in the rate of change, it can be determined when the interface has been driven down to the region immediately below the bottom of the casing at the upper end of the chimney.

8 Claims, 4 Drawing Sheets

(56) References Cited

U.S. PATENT DOCUMENTS

| | | | | |
|---|---|---|---|---|
| 8,583,378 | B2 | 11/2013 | Jacques et al. | |
| 9,181,776 | B2 * | 11/2015 | Tunget | E21B 41/0035 |
| 9,669,997 | B2 * | 6/2017 | McCoy | B65G 5/00 |
| 10,323,971 | B2 * | 6/2019 | McCoy | B65G 5/00 |

OTHER PUBLICATIONS

Berest P., Bergues j., Brouard B., Durup G., Guerber B., "A Tentative Evaluation of the MIT",Apr. 14-17, 1996, Housaton SMRI Spring Meeting, Houston SMRI Spring Meeting, Solution Mining Research Institute.

Brouard B., Gerard D., "Tightness Tests in Salt-Cavern Wells", Spring 2002 Meeting Apr. 28-May 1, 2002Banff, Alberta, Canada, Solution Mining Research Institute.

Bary A., Crotogino F., Prevedel B. Berger, H., Brown, K., Frantz, J., Sawyer, W., Henzell, M., Mohmeyer K., Ren N., Stiles K., Xiong H., "Storing Natural Gas Underground", Summer 2002, pp. 2-17, Oilfield Review.

Berest P., Brouard B., "Safety of Salt Caverns Used for Underground Storage", 2002, 8th Portuguese Congress for Geotechnique.

Berest P., Brouard B., "Safety of Salt Caverns Used for Underground Storage", vol. 58 (2003), No. 3, pp. 361-384, Oil and Gas Science and Technology—rev. IFP.

Brouard B., Karimi-Jafari M., Berest P., Durup G., "Pressure Build-Up in a Sealed Cavern: The effect of a Gas Blanket", Spring 2007 Conference, Apr. 2-May 2, 2007, Basel Switzerland, Solution Mining Research Institute.

Kansas Department of Health and Environment, "Nitrogen/Brine Interface Mechanical Integrity Test (MIT), Part I: Casing (Internal) MIT, Part II: Cavern (External) MIT", Jun. 6, 2011, Bureau of Water-Geology Section, Topeka, Kansas.

Brouard B., Berest P., Gillard P., "Set-Up of a Broken-Casings Detection System", SMRI Spring 2012 Technical Conference Apr. 23-24, Regina, Saskatchewan, Canada, Solution Mining Research Institute.

Brouard B., Bertest P., Crabeil J., "Sounds Good? Determination of a Gas/Brine Interface by an Acoustic Method at Manosque", SMRI Fall 2012 Technical Conference, Oct. 1-2, Bremen, Germany, Solution Mining Research Institute.

* cited by examiner

PROFILE MEASUREMENT FOR UNDERGROUND HYDROCARBON STORAGE CAVERNS

CROSS REFERENCE TO RELATED APPLICATION(S)

Applicant has filed copending applications entitled "Method for Detecting Leakage in an Underground Hydrocarbon Storage Cavern", filed Apr. 25, 2015 and having Ser. No. 14/696,387, Method for Determining the profile of an Underground Hydrocarbon Storage Cavern, filed Apr. 25, 2015 and having Ser. No. 14/696,389 (now U.S. Pat. No. 9,669,997) and Method for Determining the profile of an Underground Hydrocarbon Storage Cavern, filed May 2, 2017 and having Ser. No. 15/584,962.

BACKGROUND

1. Field of the Invention

The field of the present invention is that of test and measurement equipment used in the oil and gas industry, which includes the use of large volume underground storage caverns for storing substantial quantities of petroleum products, such as crude oil, propane and refined petroleum products, and in particular to the determination of the configuration of such caverns.

2. Description of the Related Art

In the use of underground storage caverns, it is important to determine the approximate shape and volume of the cavern or sections of the cavern. This has heretofore been done by lowering a wireline device into the cavern and using sonic devices to measure distances from the device to the cavern wall. Another technique has been to pump a liquid into the annulus and determine cavern volume by measuring the liquid pressure and volume at the annulus and central tubing at the well surface. Wireline operations are complex, expensive and subject to leakage of gas or liquid from the wellhead or wireline connectors. Prior cavern survey techniques are shown in U.S. Pat. No. 2,792,708, issued May 21, 1957 entitled "Testing Underground Storage Cavities" and U.S. Pat. No. 3,049,920, issued Aug. 21, 1962 entitled "Method of Determining Amount of Fluid in Underground Storage".

BRIEF DESCRIPTION OF THE DRAWINGS

For a more complete understanding of the present invention and the advantages thereof, reference is now made to the following description taken in conjunction with the accompanying original drawings in which.

DETAILED DESCRIPTION OF THE INVENTION

Multiple embodiments of the present invention are now described in reference to the FIGS. 1-6. This invention is for use with an underground storage cavern, which is also referred to as a storage well.

An important objective of the present invention is to determine when a gas/liquid interface, which is driven downward by injection of gas into the casing, is located at a position in a region immediately below the casing shoe. The casing shoe is positioned at the bottom of the string of casing in the storage well. The interface level is termed a reference level. This operation is a part of a process for measuring the profile of a chimney of an underground storage cavern.

Measuring the profile of a chimney of a storage cavern is important because it can indicate the mechanical integrity of the chimney portion of the storage cavern. If the profile is measured periodically, for example, every five years, each measurement can be compared to the last measurement. If the present measurement is substantially the same, the chimney is likely to be maintaining structural integrity. But if there is a substantial change, it is likely that the chimney has been damaged by a wall collapse, erosion, leakage or possibly blockage. The walls of the chimney are salt, which can dissolve, erode or break. A change in the chimney can damage the casing, the casing shoe or weaken the formation above the chimney and lead to leakage of liquid or gas out of the cavern into the underground formation regions near the well. This in turn could lead to gas or liquid leakage at the earth surface, which could result in a fire or release of toxic gas into the atmosphere, or lead to ground water contamination.

Figure 1:
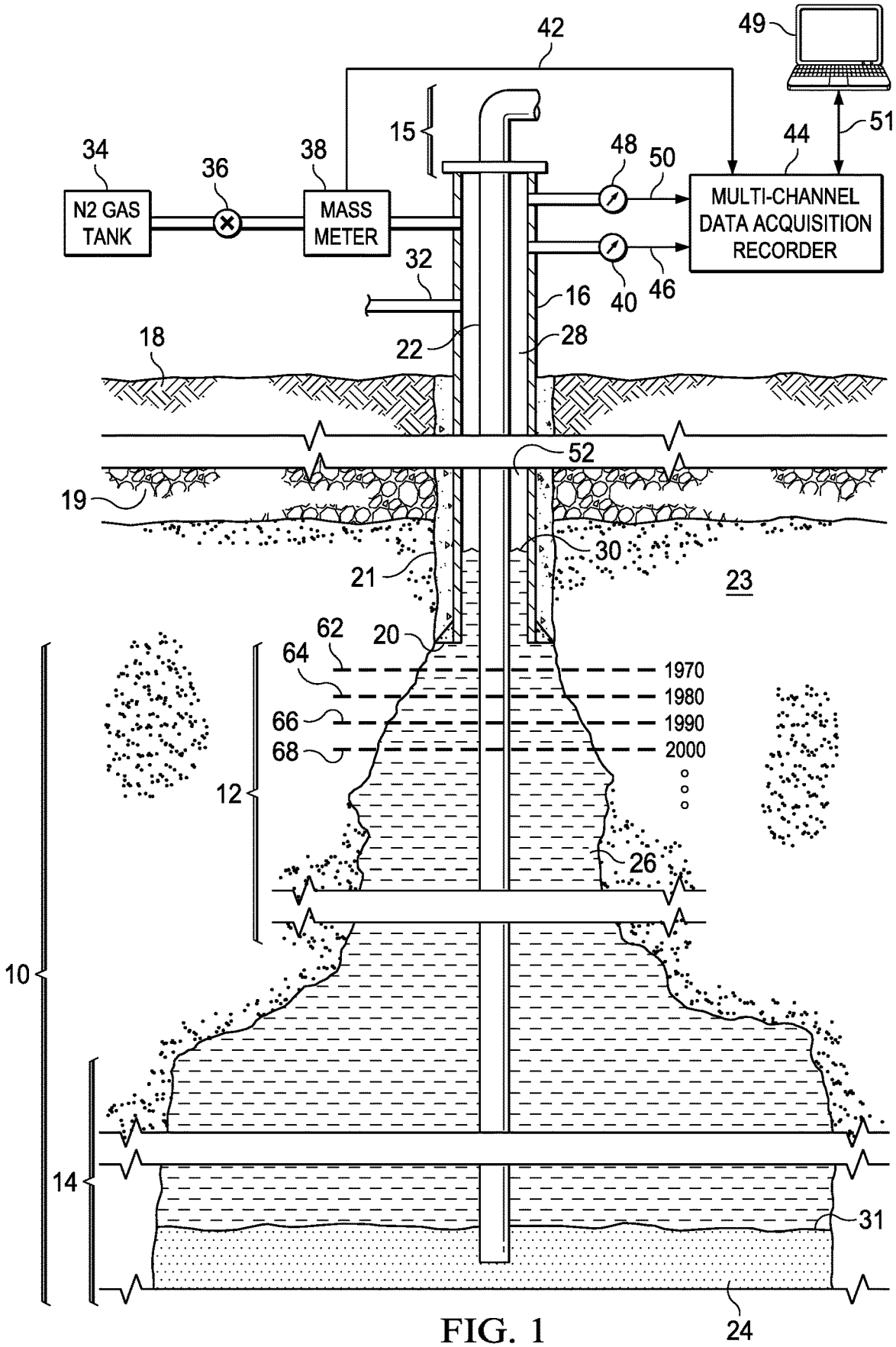
FIG. 1 is an elevation profile view of an underground storage cavern with an upper chimney section and installed casing and tubing for filling and removing liquids that are stored in the cavern, along with equipment for injecting a gas, such as nitrogen, into the casing with surface equipment for measuring the pressure and volume (mass) of injected gas.

Referring to FIG. 1, there is shown an underground storage cavern 10 which has a section termed a chimney 12 at the upper end thereof and has a cavern body 14 that is below the chimney and serves as the primary storage region for the stored liquid. The chimney can be several hundred feet high and the cavern can be over a thousand feet in depth and hundreds of feet wide. Such a cavern can have a capacity to hold several million barrels of hydrocarbon liquid, for example, crude oil.

A casing 16 is installed to extend from a wellhead tree 15 at the earth surface 18 down to the top of the chimney 12. A layer of caprock 19 lies below the earth surface 18. Below the caprock 19 and surrounding the cavern 10 is a salt formation 23. The cavern 10 is formed within the salt formation 23.

The wellhead tree 15 of the well is located at the earth surface 18. A structure termed a casing shoe 20 is positioned at the bottom of the casing 16. The casing shoe 20 provides a transition from the lower end of the casing 16 into the chimney 12. A casing liner 21, made of cement, is formed on the outside of the casing 16 and the interior of the well borehole. The depth of the casing shoe 20 in a particular well can be found in a log for that particular well and/or in a completion report for the well that is filed with the relevant authority. The cement casing liner 21 serves as a barrier to the leakage of fluids (liquid or gas) from the interior of the chimney 12 into the earth formation surrounding the casing 16. A string of tubing 22 is optionally positioned inside the casing 16. The present invention is applicable to a storage well that includes the tubing 22 and a storage well that does not have a string of tubing installed inside the casing. The tubing extends from the wellhead tree 15 down to near the bottom of the cavern body 14. The casing 16, tubing 22 and liner 21 extend through the layer of caprock 19. A liquid such as brine 24 is pumped into the cavern 10 and settles below a liquid 26 because the brine 24 is more dense than the liquid 26. The liquid 26 can be a hydrocarbon liquid such as crude oil. When brine is pumped down the tubing 22 from the surface, it serves to lift the liquid 26 upward through an annulus 28, which is a region between the casing 16 and tubing 22, and ultimately to exit the well at the surface through a flow line 32. There may be a gas/liquid interface 30 between the liquid 26 and a gas 52 in the annulus 28 and this interface can extend down into the chimney 12 and cavern body 14. A liquid/liquid interface 31 is located between the liquid 26 and the more dense brine 24.

The storage cavern 10 may have multiple casings positioned concentric about the tubing 22. Typically, the outer casings extend less deep into the earth formation than the innermost casing, such as casing 16.

Further referring to FIG. 1, a gas tank 34, preferably containing compressed or liquified nitrogen, is coupled through a valve 36 to a mass flow meter 38. An example of a mass meter 38 is a Micro Motion ELITE Coriolis Flow Meter. The valve 36 can be set to have a constant flow rate of nitrogen gas from the tank 34 to the mass meter 38 and into the casing 16. Another method for determining the mass of gas injected into the well is to weigh the gas tank 34 continuously or periodically. A weight measurement as a function of time indicates the flow rate of gas into the well. A still further technique is to measure the pressure of the gas in tank 34 and calculate the volume of gas in the tank from this pressure measurement.

Figure 2:
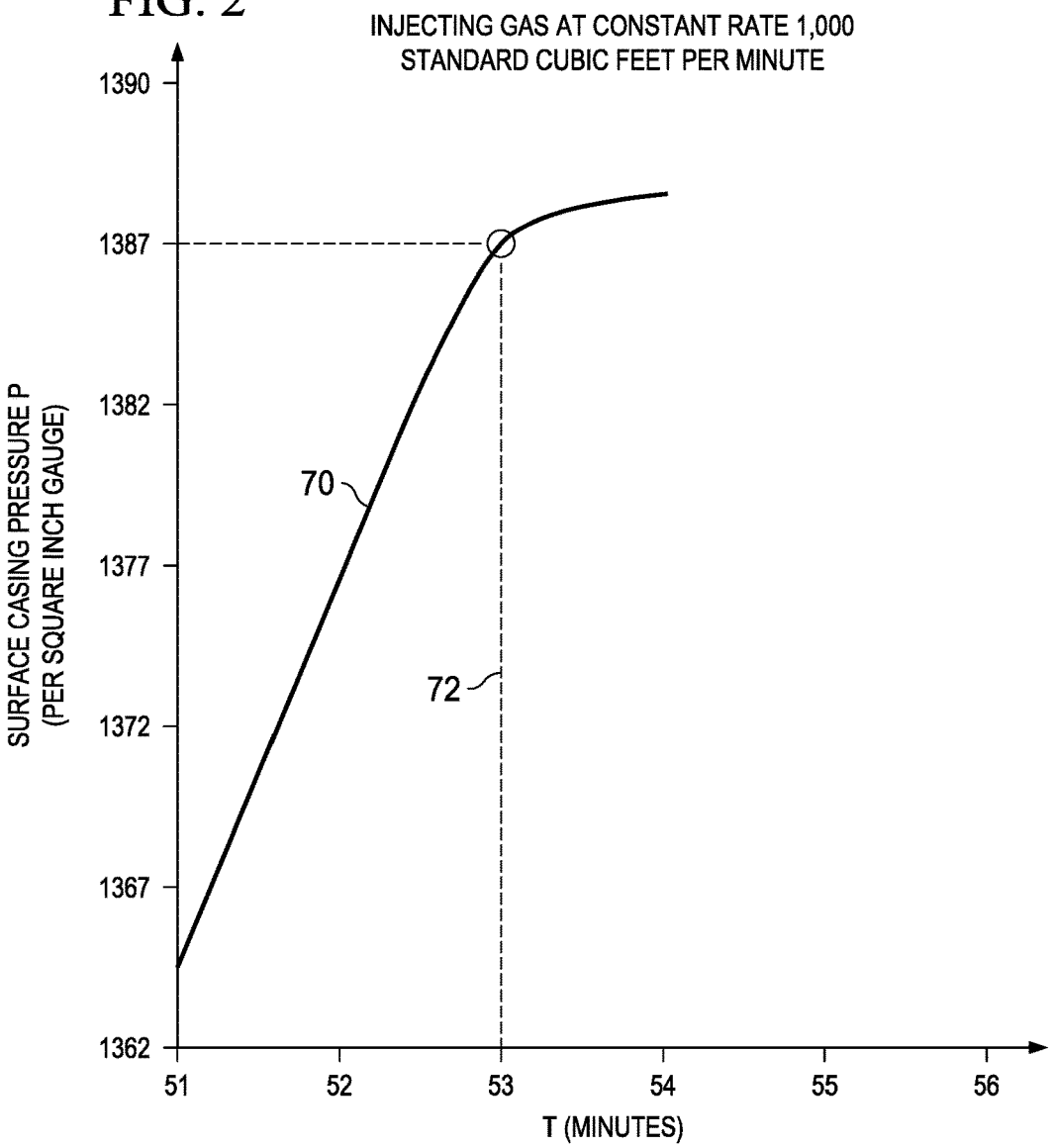
FIG. 2 is a chart illustrating measurements of surface gas pressure as a function of time.

A pressure meter 40 is mounted to the casing 16 for measuring the pressure of the gas in the casing at the earth surface. The mass meter 38 is connected through a data line 42 to a multichannel data acquisition recorder 44 so that the mass readings can be recorded as a function of time. Likewise, the pressure meter 40 is connected through a data line 46 to the recorder 44 for recording pressure measurements. Wireless links can be used in place of the data lines if desired. The surface gas pressure and gas mass readings are correlated with each other as shown in FIG. 2.

The meter 38 directly measures the mass of gas that passes through the meter. The mass reading can be converted to volume by using the well-known gas law equations. The gas volume (mass) measurement is expressed in SCF (Standard Cubic Foot).

The temperature of the gas in the casing 16 at the earth surface is measured by a thermometer 48 and the measured temperature readings are sent through a data line 50 to the recorder 44.

The recorder 44 is coupled to a computer 49 through a data line 51 to provide the data collected from the meter 38, meter 40 and thermometer 48 to the computer 49 for processing and display, as further described below.

Further referring to FIG. 1, the gas injected into the casing-tubing annulus 28 is indicated by the reference numeral 52. The interface 30 is shown in the annulus 28 and can be located at any depth in the casing 16. The interface 30 can initially be at the top of the casing 16 at the earth surface 18 and then driven downward into the well as gas 52 is injected into the casing 16 from the tank 34. Representative depth locations of the interface 30 are shown by the reference numerals 62, 64, 66, and 68. The interface 30 can be driven down into the chimney 12 and the cavern body 14.

Figure 3:
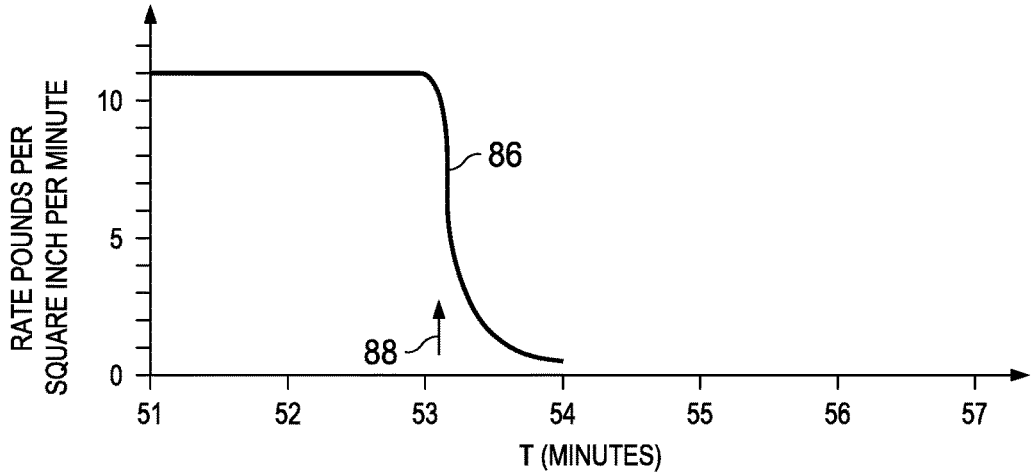
FIG. 3 is a chart derived from the data in the chart shown in FIG. 2 showing the rate of change in gas pressure as a function of time.

A first embodiment of the invention is now described in reference to FIGS. 1, 2 and 3. In this embodiment the valve 36 is set to inject a constant rate of flow of nitrogen gas from tank 34 into the casing 16. For the illustrated example, this rate is 1,000 SCF/min. The flow of gas 52 causes the gas pressure in the casing 16 at the earth surface to increase. This is shown in FIG. 2 which is a chart illustrating the increase in casing gas pressure, the vertical scale, as a function of time, the horizontal scale. A data line 70 illustrates the measured values of gas pressure as a function of time. A casing pressure rate of change is calculated by subtracting a gas pressure at a first time from a gas pressure at a second time and dividing this pressure difference by the interval of time between the first time and the second time. This chart shows that starting at time minute 51, the casing pressure increases at a constant rate until it reaches time 53:04. This rate is approximately 11 psi/min. After time 53:04 the rate of change is at a lesser rate which decreases with time. This is shown by line 72.

The values for the data shown in FIG. 2, together with the rate of change of pressure is shown in Table 1 below. The rate of change is calculated for each 12 second interval, and is expressed in psi/min. The pressure values (P1, P2, P3, . . . ) are taken at respective times (T1, T2, T3, . . . ). The calculation for pressure rate of change per unit of time (ΔP1, ΔP2, ΔP3 . . . ) is (ΔP1=[P2−P1]/[T2−T1], ΔP2=[P3−P2]/[T3−T2], . . . ), as shown in the following Table 1.

TABLE 1

| Time T (min:sec) | Pressure P (psi) | Rate of Pressure Change (ΔP psi/min) |
|---|---|---|
| 51:00 | 1364.5 | — |
| :12 | 1366.7 | 11 |
| :24 | 1368.9 | 11 |
| :36 | 1371.1 | 11 |
| :48 | 1373.3 | 11 |
| 52:00 | 1375.5 | 11 |
| :12 | 1377.7 | 11 |
| :24 | 1379.9 | 11 |
| :36 | 1382.1 | 11 |
| :48 | 1384.3 | 11 |
| 53:00 | 1386.5 | 11 |
| :12 | 1387.3 | 4 |
| :24 | 1387.8 | 2.5 |
| :36 | 1388.0 | 1.0 |

The rate of change values for the data shown in FIG. 2 are illustrated in the chart shown in FIG. 3. The calculated rate of change values are plotted as a function of time. The rate of change value is essentially constant from time 51 to time 53 at a value of 11 psi/min and then it rapidly drops to 4 psi/min at 53:12, then 2.5 psi/min at 53:24 then down to 1.0 psi/min at 53:36.

Referring back to FIG. 1 illustrates the cause for the change in the gas pressure rate of change while a constant flow rate of gas 52 is injected into the casing 16 at the surface from time 51 minutes until time 54 minutes. It has been found that in caverns such as 10, that a change in pressure of the gas in a well at a given depth causes a change in the depth of the interface that is a function of the pressure change and the gradient of the liquid at that depth. At time 51 the interface 30 is located at, or near, the earth surface 18. As the gas 52 is initially injected into the casing 16, the interface 30 is located in the annulus 28. This annulus, as shown in FIG. 1, has a constant cross section size from the earth surface 18 down to the casing shoe 20 at the bottom end of the casing 16. However, if the casing 16 has been damaged, a casing liner may be installed and this liner will have a lesser diameter. Within the reduced diameter section the rate of change of gas pressure will be constant, but the value will be different. Within any section of casing with a constant diameter, the rate of change of gas pressure will be constant. A given volume of gas injected into the casing repeatedly causes the same change in pressure because the geometry within the annulus 28 is constant. A given volume of injected gas depresses the interface 30 the same distance each time that the given volume of gas is injected. The rate of change of pressure is constant as long as the interface 30 is in the annulus 28. In FIG. 2, the interface 30 reaches the bottom of the casing 16 at the 53:04 time mark (indicated by arrow 88) and then enters into the top of the chimney 12. The top of the chimney 12 has a significantly larger cross section area in comparison to that of the annulus 28 and therefore a larger volume per unit of depth. Due to the larger volume of the chimney 12 the given volume of injected gas depresses the interface 30 a shorter distance as shown and therefore there is a smaller change in pressure. As shown in FIG. 3, the rate of pressure change from 51 min. to 53 min is 11 psi/min, but after the 53:04 time mark, the rate of pressure change per unit of time drops to 4 psi/min, then 2.5 psi/min and then to 1.0 psi/min. This corresponds to the interface 30 leaving the constant cross section annulus 28 and entering into the top region of the chimney 12 that exhibits a larger cross-sectional area.

A first technique for determining when the interface 30 leaves the bottom of the casing 16 and enters into the top of the chimney 12 is to compare each calculated pressure rate of change value to the immediately preceding pressure rate of change value and determine when a pressure rate of change value is initially less than a predetermined percentage of the value of the preceding rate of change value. If the predetermine percentage change is selected to be 50%, each pressure rate of change value is compared to the preceding rate of change value. For each of the values shown in Table 1 from time 51 to time 53, the percentage change for each value from the previous value is 0%. But from time 53:00 min to time 53:12 min, the pressure rate of change goes from 11 to 4. This is a reduction of 64%. With a threshold set at 50%, this indicates that the interface 30 entered into the top region of the chimney 12 during the time from 53:00 min to 53:12 min.

This example uses 12 seconds as the interval for calculating pressure rate of change, however, other intervals, longer or shorter, can also be used.

Another technique for determining when the interface 30 leaves the casing 16 and enters into the top region of chimney 12 is to compare each pressure rate of change value to an earlier pressure rate of change value that is not the immediately preceding value. For example, each value could be compared to the second preceding value. In the above example, there would be the same result because the second preceding value is 11 for comparison to the present value of 4. This technique could be preferred if the change in area from the annulus 28 at the end of the casing 16 into the top region of the chimney 12 is more gradual and therefore the amount of the rate of pressure change is less from sample to sample. See Table 2 below.

TABLE 2

| Time | Rate of Pressure Change (ΔP psi/min) |
|---|---|
| 51:00 | — |
| :12 | 11 |
| :36 | 11 |
| :48 | 11 |
| 52:00 | 11 |
| :12 | 10 |
| :24 | 9 |
| :36 | 6 |
| :48 | 6 |
| 53:00 | 4 |
| :12 | 3 |
| :24 | 3 |

Referring to the data in Table 2, for a rule that sets the comparison of each rate of pressure change value to the third preceding value with at least a 50% reduction, the value "4" is the value in the time sequence that meets this rule. This rule indicates that the interface 30 entered into the upper region of the chimney 12 during the time interval from 52:24 to 53:00.

A still further technique is to compare the present value to a running average of prior values. For example, the present value could be compared to the average of the preceding four rate of change values. See Table 2 above. With a 30% threshold, the first value that is less than 30% of the running average of the four preceding four values is "6". The average of the four preceding values is 10 and 6 is 40% less than 10. Using this rule, the interface 30 is indicated to have entered into the upper region of the chimney 12 during the time interval between 52:24 and 52:36.

The rule to use, and the percentage change to use, in a particular application can depend on the known or anticipated geometry of the well or the nature of the data that has been collected.

One rule is to use the average of multiple values and compare to a present measurement of rate of gas pressure change. A change from the average of 30% or 50% can indicate the inflection point. This detected change will be close to the actual point where the interface enters into the chimney. A running average of seven preceding values in Table 2 with at least a 40% difference less than the average selects the value "6" at 52:48.

Figure 4:
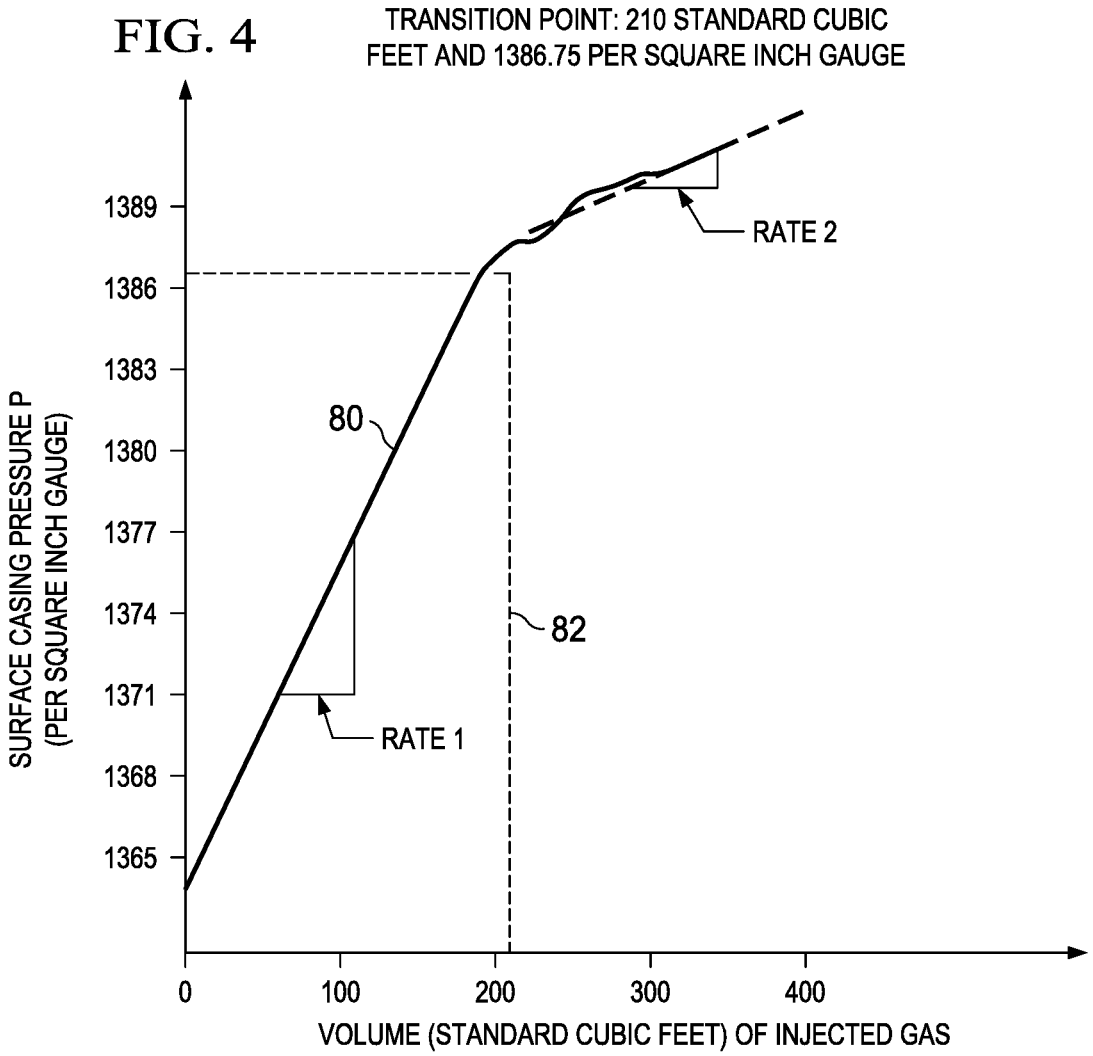
FIG. 4 is a chart illustrating measurements of casing gas pressure at the earth surface as a function of the volume of injected gas, together with two calculated rate of change (pressure/volume) measurements, Rate 1 and Rate 2.
Figure 5:
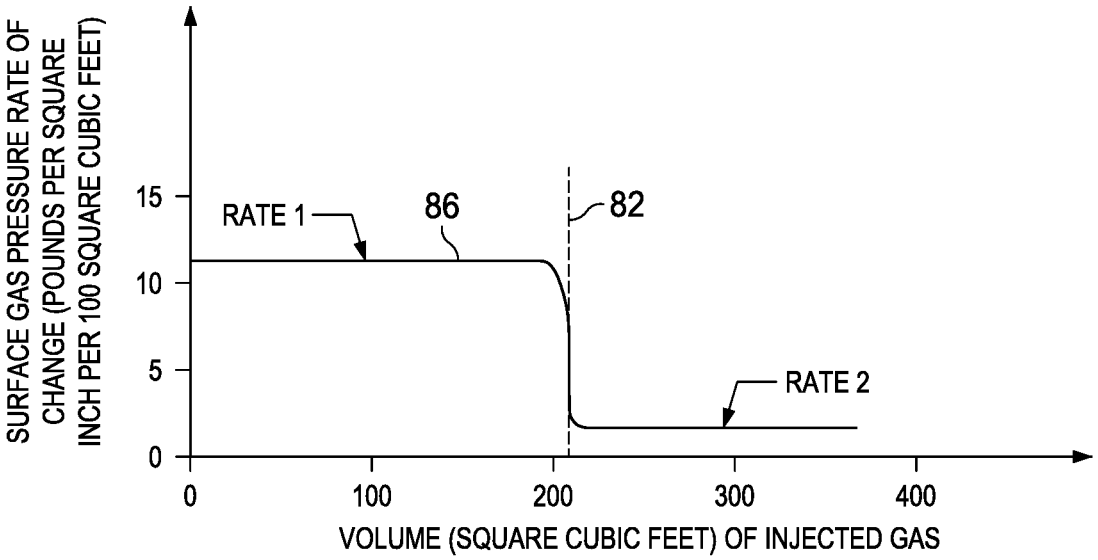
FIG. 5 is a chart derived from the chart in FIG. 4 illustrating the rates of change of gas pressure as a function of volume of injected gas.

A further embodiment of the present invention is now described in reference to FIGS. 4 and 5. For detecting the interface 30 position at the reference level, which is in the top region of the chimney 12, this embodiment utilizes the rate of change in gas pressure as a function of the cumulative volume of gas pumped into the casing 16, in contrast to the embodiment described in reference to FIGS. 2 and 3 which is based on a rate of change of gas pressure as a function of time. Referring to FIG. 4, a data line 80 is a plot of the standard volume (mass) of injected gas along the horizontal axis and the gas pressure in the casing 16 at the earth surface 18 along the vertical axis. For this set of data, the line 80 has essentially a constant average rate of change (Rate 1) of 10.8 psi/100 SCF from volume 0 to volume 210 SCF at line 82. After volume 210 SCF, the average rate of change goes down to approximately 1.25 psi/100 SCF (Rate 2).

For this embodiment, the rate of flow of gas 52 injected into the casing 16 need not be a constant rate, it can vary with time. Data points together with calculated gas pressure rates of change as a function of cumulative gas volume are shown in Table 3 below. The gas pressure rate of change (ΔP1, ΔP2, . . . ) is determined by measuring a series of gas volume measurements (V1, V2, V3 . . . ) and simultaneous time corresponding gas pressure measurements (P1, P2, P3 . . . ). The rate of gas pressure change is calculated as (ΔP1=[P2−P1]/[V2−V1], ΔP2=[P3−P2]/[V3−V2] . . . ).

TABLE 3

| Volume Injected V (SCF) | Gas Pressure P (Psig) | Rate of Gas Pressure Change ΔP (psi/100 SCF) |
|---|---|---|
| 0 | 1364.0 | — |
| 25 | 1366.7 | 10.8 |
| 50 | 1369.4 | 10.8 |
| 75 | 1372.1 | 10.8 |
| 100 | 1374.8 | 10.8 |
| 125 | 1377.5 | 10.8 |
| 150 | 13180.2 | 10.8 |
| 175 | 1382.9 | 10.8 |
| 200 | 1385.6 | 10.8 |
| 225 | 1387.4 | 1.8 |
| 250 | 1389.0 | 1.6 |
| 275 | 1390.25 | 1.25 |
| 300 | 1391.5 | 1.25 |

For this embodiment, the methods for detecting when the interface 30 has entered into the top region of the chimney 12 are the same as described above. First technique is when a gas pressure rate of change value is less than a predetermined percentage of an immediately preceding value. If the predetermined percentage is 50%, the identified rate of change value in Table 3 is 1.8 which corresponds to the injected gas volume of 225 SCF. If the value is compared to a third preceding value, the result is also the 1.8 value. The comparison of a running average of the preceding four rate of change of gas pressure values with a predetermined percentage of 30% also selects the 1.8 psi/100 SCF value. This selection indicates that the interface 30 enters into the topmost region of the chimney 12 between the measurements of 200 SCF and 225 SCF. A running average of seven prior values with at least a 40% change deems the 1.8 value as the transition reading.

FIG. 5 is a chart with data curve 86 showing the relation of the cumulative volume of injected gas 52 with the rate of change of gas pressure in the casing 16 at the earth surface 18. The gas injection is started when the interface 30 is located at or near the earth surface. As the interface 30 is pushed downward in the casing annulus 28, the rate of increase in surface pressure is uniform because the geometry of the annulus cross section is constant, if the internal diameter of the casing remains constant. When approximately 200 SCF of gas has been injected, the pressure rate of change begins to drop substantially as a function of the volume of injected gas. Note that the gas pressure does not drop, it is the rate of change in the gas pressure that drops. This is due to the interface 30 entering into the top region of the chimney 12 which has a much larger volume per unit of depth than that of the casing annulus 28. Much more gas is required to lower the interface a given distance than was needed to lower the interface such a given distance in the casing annulus 28.

Multiple embodiments of the invention are described above to detect when the interface 30, which is driven downward into the well by the injection of gas, passes through the bottom end of the casing 16 into the top region of the chimney 12, by identifying when a sudden change occurs in the gas pressure rate of change, in comparison to either time or volume of injected gas. When the interface 30 is located immediately below the casing shoe 20, typically within two to five feet, this is termed the reference level of the interface 30. After the interface 30 has been determined to be at this reference level, further steps in accordance with the invention are to measure the volumes of sections of the chimney 12 located below the reference level. This constitutes establishing a profile of the chimney 12.

Referring to FIG. 1, the interface 30 can be driven downward to the depth 62, which is the reference level detected as described above. The next measurements and calculations are directed to determining the volume of the chimney 12 at measured depths. In particular, the measurements are directed to determining change in depth values (Δd1, Δd2, Δd3 . . . ) based on changes in gas pressure measurements at these depths in the cavern storage well. The pressure measurements at these depths are termed Pd1, Pd2, Pd3, . . . . The change in gas pressure measurements at these depths are termed ΔPd1, ΔPd2, ΔPd3 . . . The changes in depths are calculated by the formula Δd1=ΔPd1/G, Δd2=ΔPd2/G, G is the gradient (psi/foot) of the hydrocarbon liquid. The gradient G can vary with depth. The gradient (psi/foot) of the liquid 26 is either measured for the well under test or determined by reference to standard values for the type of liquid 26 in the well.

The pressure at a particular depth is based on the surface pressure measurement of the gas pressure in the casing 16 at the earth surface. The pressure at a depth, such as depth 62, shown in FIG. 1. is the surface measured pressure plus the pressure due to the weight of the gas column from the surface down to the depth 62. The weight of this column is determined by the length of the column, the chemical composition of the gas, the pressure of the gas and the temperature of the gas. These calculations for down-hole pressure are well known in the art and widely used in the oil and gas industry. Table 4 below illustrates downhole pressure calculated from surface pressure for a particular well. Similar calculations can be made for any storage cavern well.

TABLE 4

| Depth (feet) | Interface Pressure at Depth Pd (Psig) | Surface Pressure P (Psig) |
|---|---|---|
| 0 | 773.7 | 773.7 |
| 100 | 809.8 | 807.2 |
| 197 | 844.8 | 839.6 |
| 300 | 881.9 | 873.8 |
| 400 | 918.0 | 907.0 |
| 500 | 930.1 | 940.0 |
| 600 | 990.1 | 972.8 |
| 748 | 1043.5 | 1020.9 |
| 800 | 1062.3 | 1037.7 |
| 900 | 1098.3 | 1069.3 |
| 1000 | 1134.4 | 1100.7 |
| 1100 | 1170.5 | 1131.7 |
| 1200 | 1206.5 | 1162.3 |
| 1300 | 1242.6 | 1192.6 |
| 1400 | 1278.7 | 1223.2 |
| 1450 | 1296.7 | 1238.4 |
| 1500 | 1314.8 | 1253.6 |
| 1600 | 1350.8 | 1283.7 |
| 1700 | 1386.7 | 1313.6 |
| 1800 | 1423.0 | 1343.3 |
| 1900 | 1459.0 | 1372.7 |
| 1970 | 1484.3 | 1393.1 |
| 1985 | 1489.7 | 1397.5 |
| 2000 | 1495.1 | 1401.8 |

The actual volume of gas at a depth in the well due to the injection of gas at the surface is less than the measured standard volume of gas injected at the surface due to the greater gas pressure and temperature at the depth. The calculation of the volume of gas at depths in the well is well known in the art and widely used in the oil and gas industry. The standard volume (mass) of injected gas injected at the surface between two points in time is known together with the surface pressure and temperature. The pressure and temperature at depth are known. The temperature at each depth is available from a temperature survey previously taken for the well, or known for a geographic region. The actual volume at depth is calculated by use of the gas law equations using all of these parameters, which are the standard volume, at the surface pressure and temperature, and the at depth pressure and temperature. See Table 5 below showing the standard volume of gas injected at the surface and the corresponding actual volume at given depths. For example, for 49.8 SCF of N2 injected at the surface, there is a one cubic foot displacement at 0 depth (the earth surface). But when the interface is at, for example 1400 feet, there must be an injection at the surface of 74.0 SCF of N2 for a of one cubic foot volume of gas at 1400 feet. The at-depth volume of gas is based on the standard volume (mass) of gas injected at the surface.

TABLE 5

| Depth (feet) | SCF of N2 Gas/Cu. Ft (Avg. P & T) ) |
|---|---|
| 0 | 49.8 |
| 100 | 51.4 |
| 197 | 52.9 |
| 300 | 30.5 |
| 400 | 56.0 |
| 500 | 57.4 |
| 600 | 58.9 |
| 748 | 61.5 |
| 800 | 62.2 |
| 900 | 64.0 |
| 1000 | 65.8 |
| 1100 | 67.8 |
| 1200 | 69.8 |
| 1300 | 71.9 |
| 1400 | 74.0 |
| 1450 | 75.1 |
| 1500 | 76.1 |
| 1600 | 78.2 |
| 1700 | 80.2 |
| 1800 | 82.3 |
| 1900 | 84.3 |
| 1970 | 85.6 |
| 1985 | 86.1 |
| 2000 | 86.5 |

Figure 6:
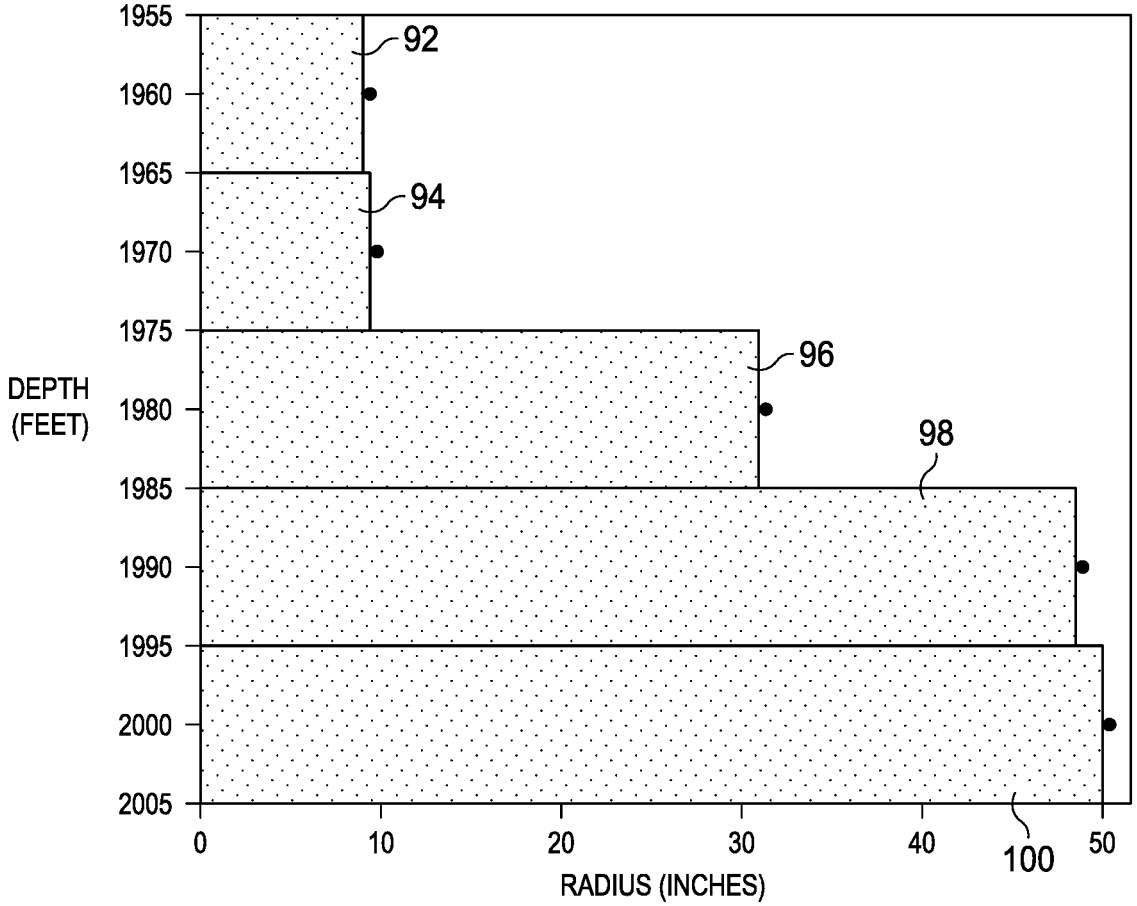
FIG. 6 is a bar graph chart illustrating the calculated radius of the casing and the upper chimney region of the cavern as a function of depth below the surface, which is an illustration of a chimney profile.

Referring to FIG. 1, when the interface 30 has been depressed to depth 62, the reference level, the surface gas pressure is measured and additional gas is injected. A second gas pressure measurement is made and the standard volume of gas injected between the gas pressure measurements is determined. The two surface pressure measurements are used to determine the at-depth pressure values, as discussed above. The difference in these two pressure values (Pd2–Pd1) is multiplied by the gradient G of the hydrocarbon liquid and the product is the distance (Δd1) that the interface moved between the two pressure measurements. Δd1 is the distance that the interface 30 moved downward from the reference level. If the Δd1 value is 10 feet, the resulting depth of the interface is depth 64 as shown in FIG. 1. The incremental standard volume of gas injected at the surface is used to determine the actual volume of liquid displaced by the additional gas ΔV1 between the depths 62 and 64. The measured profile volume of the chimney 12 between depths 62 and 64 is a height of Δd1 and a volume of ΔV1. Assuming that the chimney 12 has a cylindrical geometry and there is no tubing string in the cavern, the cavern radius (rc) is determined by the formula ($rc=\sqrt{(V\div(\Delta d\pi))}$) This radius is illustrated in FIG. 6 for each depth interval. If there is a tubing string present in the cavern, and the tubing string has a radius of rt, the cavern radius rc is ($rc=\sqrt{(V\div(\Delta d\pi)+rt^2)}$)

When the interface 30 has been driven down to the depth 64 and the pressures and gas volume has been recorded, more gas is injected to drive the interface 30 further downward. A new at-depth pressure is determined from a surface measurement and the volume of gas injected at the surface is measured and used to determine the volume of gas at the depth between the last two pressure measurements. The depth of movement Δd2 is determined as described above using the pressure differential at the depths and the gradient of the liquid 26. This determines the height and volume for another profile section of the chimney 12. The radius for this profile section of chimney 12 is then calculated.

FIG. 6 is a bar graph that shows the radius of the chimney 12 (horizontal axis) as a function of the depth (vertical axis) in the cavern storage well. Each of the bars 92, 94, 96, 98 and 100 represent a radius in the casing 16 or the chimney 12 at the indicated depths. For example, bars 92 and 94 represent the radius of the casing 16. This calculation takes into consideration the cross-section area of the tubing 22 and therefore the volume of the tubing 22. Bars 98 and 100 indicate an average radius in the chimney 12 of approximately 50 inches at depth range 1985-1995 for bar 98 and depth range 1995-2005 for bar 100. The radius values are produced as described above. The bar graph in FIG. 6 can be used as a reference to compare to future profile measurements for the chimney 12 to evaluate the mechanical integrity of the chimney 12 over time.

Although several embodiments of the invention have been illustrated in the accompanying drawings and described in the foregoing Detailed Description, it will be understood that the invention is not limited to the embodiments disclosed, but is capable of numerous rearrangements, modifications and substitutions without departing from the scope of the invention.

What is claimed is:

1. A method for use in a cavern storage well which has a casing that extends from an earth surface down to a chimney region that has a top region which is adjacent to a lower end of said casing, the chimney region extends downward and opens into a cavern body wherein hydrocarbon liquid is stored in the cavern body above a liquid more dense than the hydrocarbon liquid, the method indicting when an interface between a gas, which has mass, and the hydrocarbon liquid is located at the top region of said chimney region a short distance below the lower end of said casing, comprising the steps of:

injecting the gas, by application of pressure to the gas, into said casing at the earth surface to drive the interface downward, measuring the pressure of said gas in said casing at the earth surface as said gas is injected into said casing to produce a series of gas pressure measurements (P1, P2, P3 . . . ) at a sequence of corresponding times (T1, T2, T3 . . . ), producing a series of gas pressure rate of change values (ΔP1, ΔP2, . . . ) based on said gas pressure measurements and time intervals between said times for adjacent pairs of said gas pressure measurements ($\Delta P1=[P2-P1]/[T2-T1]$, $\Delta P2=[P3-P2]/[T3-T2]$ . . . ), and comparing each of a group of said gas pressure rate of change values ($\Delta P1$, $\Delta P2$, . . . ) to a preceding one of said gas pressure rate of change values to detect when one of said gas pressure rate of change values is initially less than a predetermined percentage of said preceding one of said gas pressure rate of change values, thereby indicating that said interface is located within the top region of said chimney region below the lower end of said casing between the times when said less than a predetermined percentage gas pressure rate of change value gas pressure measurements were made.

2. The method recited in claim 1 wherein said preceding one of said gas pressure rate of change values is an immediately preceding gas pressure rate of change value before said gas pressure rate of change value which was detected to have a value that is initially less than a predetermined percentage of a preceding gas pressure rate of change value.

3. The method recited in claim 1 wherein said preceding one of said gas pressure rate of change value is one of the preceding gas pressure rate of change values other than an immediately preceding gas pressure rate of change value before said pressure rate of change value which was detected to have a value that is initially less than a predetermined percentage of a preceding gas pressure rate of change value.

4. The method recited in claim 1 including the following steps for producing a profile of said chimney region:

after aid interface has been located at the top region of said chimney region below the lower end of said casing, further injecting said gas into said casing at said earth surface and measuring said gas pressure at the earth surface to produce a series of death gas pressure measurements (Pd1, Pd2, Pd3, . . . ), measuring the mass of said gas injected into said casing between each pair of said depth pressure measurements, determining a series of change in depth values ($\Delta d1$, $\Delta d2$, $\Delta d3$ . . . ), each of said change in depth values based on a gas pressure change value ($\Delta Pd1$, $\Delta Pd2$, . . . ) between two adjacent depth gas pressure measurements ($\Delta Pd1=Pd2-Pd1$, $\Delta Pd2=Pd3-Pd2$, . . . ) and a gradient (G pressure/distance) value of said hydrocarbon liquid, wherein the change in depth values are ($\Delta d1=\Delta Pd1/G$, $\Delta d2=\Delta Pd2/G$, . . . ), and wherein a series of profile measurements of said chimney region are produced, each said profile measurement defined by (1) a change in depth value and (2) a volume of gas caused by said mass of said gas injected into said casing between each pair of corresponding depth gas pressure measurements which define the change in depth value (1).

5. The method recited in claim 1 wherein said predetermined percentage is 50%.

6. A method for use in a cavern storage well which has a casing that extends from an earth surface down to a chimney region that has a top region which is adjacent to a lower end of said casing, the chimney region extends downward and opens into a cavern body wherein hydrocarbon liquid is stored in the cavern body above a liquid more dense than the hydrocarbon liquid, the method indicating when an interface of a gas, which has mass, with the hydrocarbon liquid is located at the top region of said chimney region a short distance below the lower end of said casing, comprising the steps of:

injecting the gas, by application of pressure to the gas, into said casing at the earth surface to drive the interface downward, measuring the pressure of said gas in said casing at the earth surface as said gas is injected into said casing to produce a series of gas pressure measurements (P1, P2, P3 . . . ) at a sequence of corresponding times (T1, T2, T3 . . . ), producing a series of gas pressure rate of change values ($\Delta P1$, $\Delta P2$, . . . ) based on said gas pressure measurements and time intervals between said times for adjacent pairs of said gas pressure measurements ($\Delta P1=[P2-P1]/[T2-1]$, $\Delta P2=[P3-P2]/[T3-T2]$ . . . ), and comparing each of said gas pressure rate of change values ($\Delta P1$, $\Delta P2$, . . . ) to a running average value of a plurality of preceding ones of said gas pressure rate of change values to detect when a one of said gas pressure rate of change values is initially less than a predetermined percentage of the running average value, thereby indicating that said interface is located within the top region of said chimney region below the lower end of said casing between the times when said gas pressure measurements were made for the less than predetermined percentage gas pressure rate of change value.

7. The method recited in claim 6 including the following steps for producing a profile of said chimney region:

after said interface has been located at the top region of said chimney region below the lower end of said casing, further injecting said gas into said casing at said earth su ace and measuring said gas pressure at the earth surface to produce a series of depth gas pressure measurements (Pd1, Pd2, Pd3, . . . ), measuring the mass of said gas injected into said casing between each pair of said depth gas pressure measurements, determining a series of change in depth values ($\Delta d1$, $\Delta d2$, $\Delta d3$ . . . ), each of said change in depth values based on a gas pressure change value ($\Delta Pd1$, $\Delta Pd2$, . . . ) between two adjacent ones of said depth gas pressure measurements ($\Delta Pd1=Pd2-Pd1$, $\Delta Pd2=Pd3-Pd2$, . . . ) and a gradient (G pressure/distance) value of said hydrocarbon liquid, wherein the change in depth values are ($\Delta d1=\Delta Pd1/G$, $\Delta Pd2=\Delta Pd2/G$, . . . ), and wherein a series of profile measurements of said chimney region are produced, each said profile measurement defined by (1) a change in depth value and (2) said mass of said gas injected into said casing between each pair of corresponding depth gas pressure measurements which define the change in depth value (1).

8. The method recited in claim 6 wherein said running average comprises seven of said gas pressure rate of change values.

* * * * *